US008824943B2

(12) United States Patent
Kikuchi

(10) Patent No.: US 8,824,943 B2
(45) Date of Patent: Sep. 2, 2014

(54) FUSER INCLUDING FIXING BELT

(75) Inventor: Kazuhiko Kikuchi, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/592,898

(22) Filed: Aug. 23, 2012

(65) Prior Publication Data

US 2013/0051879 A1 Feb. 28, 2013

Related U.S. Application Data

(60) Provisional application No. 61/528,674, filed on Aug. 29, 2011, provisional application No. 61/528,675, filed on Aug. 29, 2011.

(51) Int. Cl.
*G03G 15/20* (2006.01)

(52) U.S. Cl.
USPC ..... 399/328; 399/331

(58) Field of Classification Search
CPC ..... G03G 15/2089; G03G 15/2053; G03G 15/20; G03G 2215/2022; G03G 2215/2032; G03G 2215/2035; G03G 2215/2048
USPC ..... 399/328, 331
See application file for complete search history.

(56) References Cited

U.S. PATENT DOCUMENTS

| | | | | |
|---|---|---|---|---|
| 2005/0163542 | A1* | 7/2005 | Gilmore et al. | 399/329 |
| 2006/0029444 | A1 | 2/2006 | Naito et al. | |
| 2007/0071517 | A1* | 3/2007 | Blair et al. | 399/329 |
| 2007/0071518 | A1* | 3/2007 | Blair et al. | 399/329 |
| 2007/0122173 | A1* | 5/2007 | Mitsuoka et al. | 399/69 |
| 2010/0226700 | A1* | 9/2010 | Yamada et al. | 399/329 |
| 2011/0064493 | A1* | 3/2011 | Muramatsu et al. | 399/329 |
| 2011/0222894 | A1* | 9/2011 | Yamamoto et al. | 399/329 |

* cited by examiner

*Primary Examiner* — Ryan Walsh
(74) *Attorney, Agent, or Firm* — Patterson & Sheridan LLP

(57) ABSTRACT

According to one embodiment, a fuser includes a fixing belt including a conductive layer, an induction-current generating section configured to electromagnetically induction-heat the conductive layer, a pressurizing section opposed to the outer circumference of the fixing belt, and a nip forming section including a first supporting roller present in the inner circumference of the fixing belt and shorter than the width of the pressurizing section and a second supporting roller present downstream of the first supporting roller in a rotating direction of the fixing belt and shorter than the width of the pressurizing section, the nip forming section being configured to form a nip between the fixing belt and the pressurizing section.

8 Claims, 6 Drawing Sheets

FUSER INCLUDING FIXING BELT

CROSS-REFERENCE TO RELATED APPLICATION

This application is based upon and claims the benefit of priority from Provisional U.S. Applications 61/528,674 filed on Aug. 29, 2011 and 61/528,675 filed on Aug. 29, 2011 the entire contents of which are incorporated herein by reference.

FIELD

Embodiments described herein relate generally to a fuser used in an image forming apparatus and, more particularly, to a fuser that reduces a load applied to a fixing belt in a nip position.

BACKGROUND

An image forming apparatus such as a copying machine or a printer includes a fuser in which a fixing belt having a small heat capacity is used to save consumed energy of a heating source and realize a quick rise in temperature of the fixing belt. In a fixing belt that rotates with both ends thereof supported by flanges, tension in the circumferential direction is not applied to an intermediate region in a rotation axis direction of the fixing belt. Therefore, there is a fuser in which pressing member is arranged on the inner side of the fixing belt and the fixing belt is held between the pressing member and a pressurizing roller to form a nip.

In the fuser that forms the nip using the pressing member, if a friction force of the fixing belt and the pressing member is large, a load applied to the fixing belt increases. Therefore, it is necessary to increase rotation torque necessary for the rotation of the fixing belt. If the friction force of the fixing belt and the pressing member is large, it is likely that the fixing belt is worn down and deterioration of the fixing belt is accelerated.

DETAILED DESCRIPTION

In general, according to one embodiment, a fuser includes: a fixing belt including a conductive layer; an induction-current generating section configured to electromagnetically induction-heat the conductive layer; a pressurizing section opposed to the outer circumference of the fixing belt; and a nip forming section including a first supporting roller present in the inner circumference of the fixing belt and shorter than the width of the pressurizing section and a second supporting roller present downstream of the first supporting roller in a rotating direction of the fixing belt and shorter than the width of the pressurizing section, the nip forming section being configured to form a nip between the fixing belt and the pressurizing section.

An embodiment is explained below.

Figure 1:
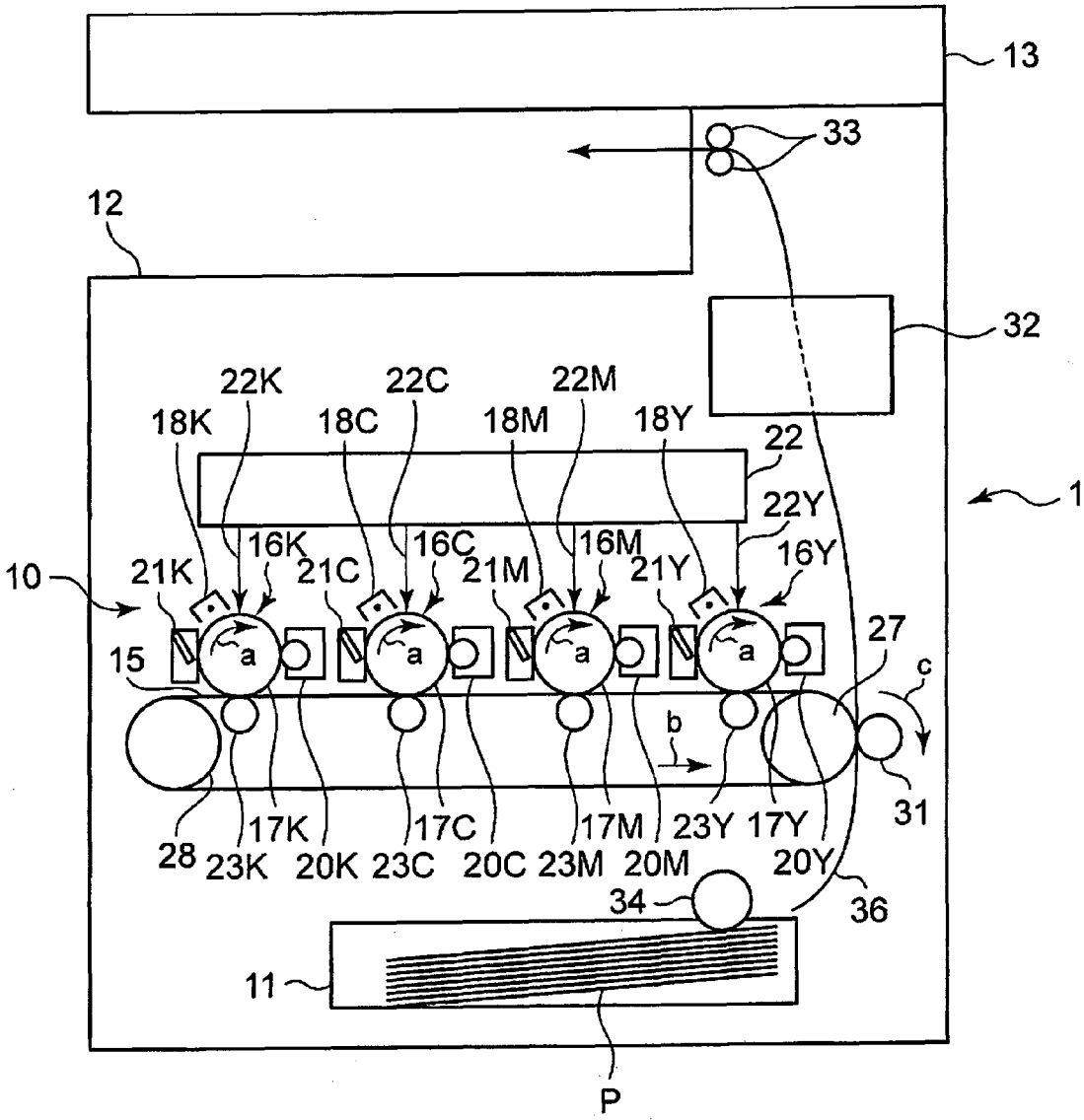
FIG. 1 is a schematic configuration diagram of an MFP mounted with a fuser, according to an embodiment.

FIG. 1 is a schematic configuration diagram of a color MFP (Multi Functional Peripheral) 1, which is an image forming apparatus of a tandem system mounted with a fuser according to an embodiment. The MFP 1 includes a printer section 10, a paper feeding section 11 including a pickup roller 34, a paper discharge section 12, and a scanner 13.

The printer section 10 includes four sets of image forming stations 16Y, 16M, 16C, and 16K for Y (yellow), M (magenta), C (cyan), and K (black) arranged in parallel along an intermediate transfer belt 15. The image forming stations 16Y, 16M, 16C, and 16K respectively include chargers 18Y, 18M, 18C, and 18K, developing devices 20Y, 20M, 20C, and 20K, and photoconductive member cleaners 21Y, 21M, 21C, and 21K around photoconductive drums 17Y, 17M, 17C, and 17K that rotate in an arrow "a" direction. A laser exposure device 22 of the printer section 10 irradiates a laser beam on the photoconductive drums 17Y, 17M, 17C, and 17K to form electrostatic latent images thereon.

A backup roller 27 and a driven roller 28 support the intermediate transfer belt 15 and cause the intermediate transfer belt 15 to travel in an arrow "b" direction. Primary transfer rollers 23Y, 23M, 23C, and 23K present on the inner side of the intermediate transfer belt 15 primarily transfer toner images formed on the photoconductive drums 17Y, 17M, 17C, and 17K onto the intermediate transfer belt 15 and superimpose the toner images on the intermediate transfer belt 15. The photoconductive member cleaners 21Y, 21M, 21C, and 21K remove toners remaining on the photoconductive drums 17Y, 17M, 17C, and 17K after the primary transfer.

A secondary transfer roller 31 present in a position opposed to the backup roller 27 via the intermediate transfer belt 15 rotates in an arrow "c" direction following the intermediate transfer belt 15. The secondary transfer roller 31 collectively secondarily transfers the toner images on the intermediate transfer belt 15 onto a sheet P, which is a recording medium, supplied from the paper feeding section 11 along a conveying path 36.

The intermediate transfer belt 15, the image forming stations 16Y, 16M, 16C, and 16K, the laser exposure device 22, the primary transfer rollers 23Y, 23M, 23C, and 23K, and the secondary transfer roller 31 configure an image forming section. The printer section 10 includes a fuser 32 and a paper discharge roller pair 33 downstream of the secondary transfer roller 31 along the conveying path 36.

When printing is started, the MFP 1 forms a toner image on the sheet P in the printer section 10. After fixing the toner image on the sheet P, the MFP 1 discharges the sheet P to the paper discharge section 12.

The image forming apparatus is not limited to the tandem system. The number of developing devices is not limited either. The image forming apparatus may directly transfer the toner image from a photoconductive member to a recording medium.

Figure 2:
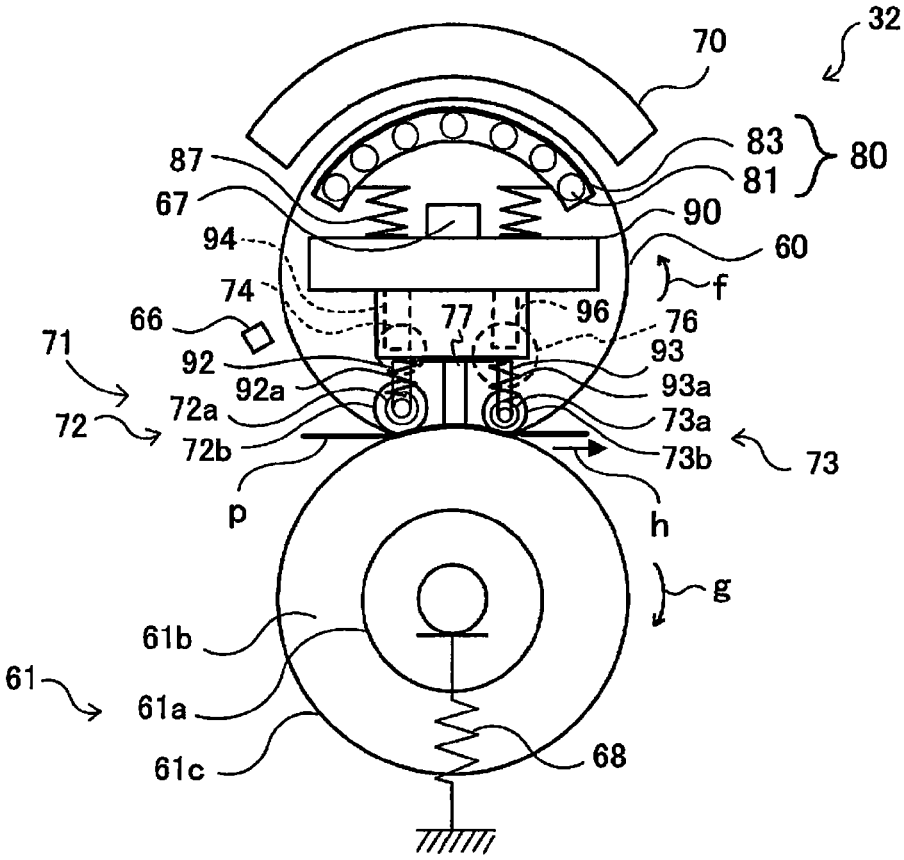
FIG. 2 is a schematic configuration diagram of the fuser viewed from a side.
Figure 3:
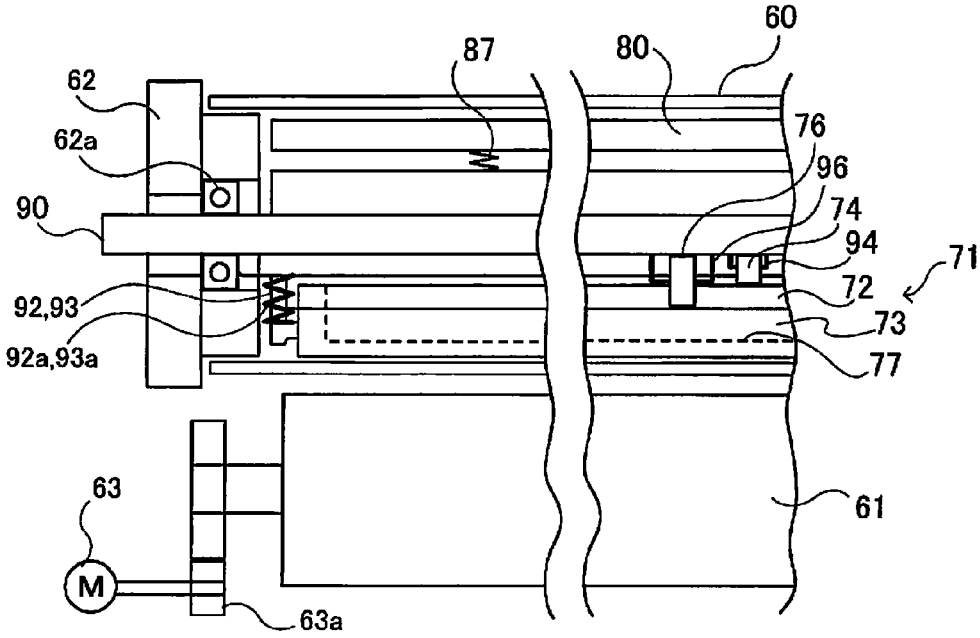
FIG. 3 is a partially-omitted schematic configuration diagram of the fuser viewed from the front.

The fuser 32 is explained in detail. As shown in FIGS. 2 and 3, the fuser 32 includes a fixing belt 60, a press roller 61, which is a pressurizing section, an induction-current generating coil (hereinafter abbreviated as IH coil) 70, which is an induction-current generating section, a nip forming section 71, an auxiliary heat generating section 80, and a stay 90. The fuser 32 includes a thermistor 66 that detects the temperature of the fixing belt 60 and a thermostat 67, which is a safety device that detects abnormal heat generation of the fuser 32.

Figure 4:
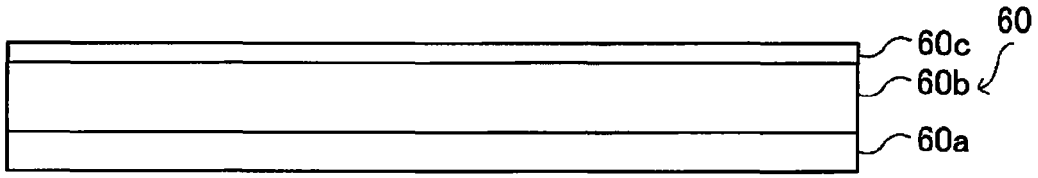
FIG. 4 is a schematic explanatory diagram of a layer configuration of a fixing belt in the embodiment.

The fixing belt 60 is a cylindrical endless belt that rotates in an arrow "f" direction. The fixing belt 60 includes, for example, as shown in FIG. 4, a conductive heat generating layer 60*a*, which is a conductive layer, an elastic layer 60*b*, and a surface release layer 60*c*. The conduction heat generating layer 60*a* inductively generates heat according to the application of an alternating current to the IH coil 70. The conductive heat generating layer 60*a* may be either a single layer or a multilayer formed by laminating different members. As the conductive heat generating layer 60A, for example, nickel (Ni), copper (Cu), or the like is used. The elastic layer 60*b* is made of an elastic body such as silicon rubber. The elastic layer 60*b* improves fixability by the fuser 32. As the surface release layer 60*c*, fluorocarbon resin such as PFA resin is used. However, the thicknesses of the elastic layer 60*b* and the surface release layer 60*c* are selected to prevent the heat capacity of the fixing belt 60 from becoming too large and realize a reduction in a warm-up time of the fuser 32.

The press roller 61 includes a heat resistant rubber layer 61*b*, for example, on the surface of a cored bar 61*a* and includes a release layer 61*c* made of fluorocarbon resin such as PFA resin on the surface of the rubber layer 61*b*. The press roller 61 is brought into contact with and separated from the fixing belt 60 by, for example, a pressurizing mechanism 68.

A flange 62 that supports an end of the fixing belt 60 fits in the inner circumference of the fixing belt 60 and keeps the fixing belt 60 substantially circular. A motor 63 rotates the press roller 61 via a gear group 63*a*. The fixing belt 60 rotates following the press roller 61. The fixing belt 60 may rotate independently from the press roller 61. The flange 62 includes a bearing 62*a* between the flange 62 and the stay 90.

The nip forming section 71 includes, in a position opposed to the press roller 61, an inlet roller 72, which is a first supporting roller, and an outlet roller 73, which is a second supporting roller, on the inner side of the fixing belt 60. The outlet roller 73 is arranged downstream of the inlet roller 72 along the rotation of the fixing belt 60 in the arrow "f" direction.

The inlet roller 72 and the outlet roller 73 are respectively configured by winding rubbers 72*b* and 73*b* around cored bars 72*a* and 73*a*. For example, the outer diameter of the outlet roller 73 is smaller than the outer diameter of the inlet roller 72. As the rubbers 72*b* and 73*b*, for example, silicon rubber or fluorocarbon rubber is used. The rubber hardness of the rubber 73*b* of the outlet roller 73 is higher than the rubber hardness of the rubber 72*b* of the inlet roller 72. The structure and the material of the inlet roller 72 and the outlet roller 73 are not limited to the structure and the material described above.

Figure 5:
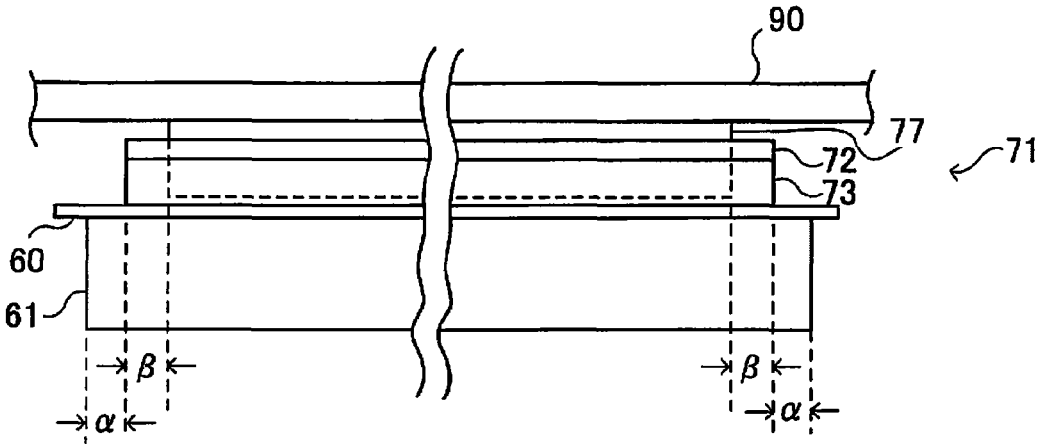
FIG. 5 is a schematic explanatory diagram for explaining the lengths of an inlet side roller, an outlet side roller, a press roller, and a guide in the embodiment.

As shown in FIG. 5, the inlet roller 72 and the outlet roller 73 are formed shorter than the press roller 61 by width (α) at the ends of the fuser 32. The inlet roller 72 and the outlet roller 73 are respectively elastically supported by brackets 92 and 93 of the stay 90 via springs 92*a* and 93*a*.

The nip forming section 71 includes an inlet pressing roller 74 that rotates in contact with the inlet roller 72 and an outlet pressing roller 76 that rotates in contact with the outlet roller 73. The inlet pressing roller 74 and the outlet pressing roller 76 respectively prevent center regions of the inlet roller 72 and the outlet roller 73 from bending. The number of inlet pressing rollers 74 and outlet pressing rollers 76 and arrangement positions of the inlet pressing roller 74 and the outlet pressing roller 76 are not limited. The inlet pressing roller 74 and the outlet pressing roller 76 are respectively supported by the stay 90 via brackets 94 and 96.

The nip forming section 71 includes a guide 77 between the inlet roller 72 and the outlet roller 73. The guide 77 is supported by the stay 90. A surface of the guide 77 opposed to the press roller 61 is formed along, for example, the shape of the outer circumference of the press roller 61. As shown in FIG. 5, the guide 77 is shorter than the inlet roller 72 and the outlet roller 73 by width (β) at both the ends of the guide 77. The guide 77 suppresses the movement of the fixing belt 60 in a direction perpendicular to a traveling direction of the fixing belt 60 between the inlet roller 72 and the outlet roller 73. The guide 77 suppresses the movement of the fixing belt 60 in the direction perpendicular to the traveling direction of the fixing belt 60, whereby the fixing belt 60 keeps a shape extending along the outer circumference of the press roller 61 from the inlet roller 72 to the outlet roller 73. The guide 77 stabilizes a nip 78 that reaches from the inlet roller 72 to the outlet roller 73.

A relation among the lengths of the press roller 61, the inlet roller 72 and the outlet roller 73, and the guide 77 is the guide 77<the inlet roller 72 and the outlet roller 73<the press roller 61.

Figure 6:
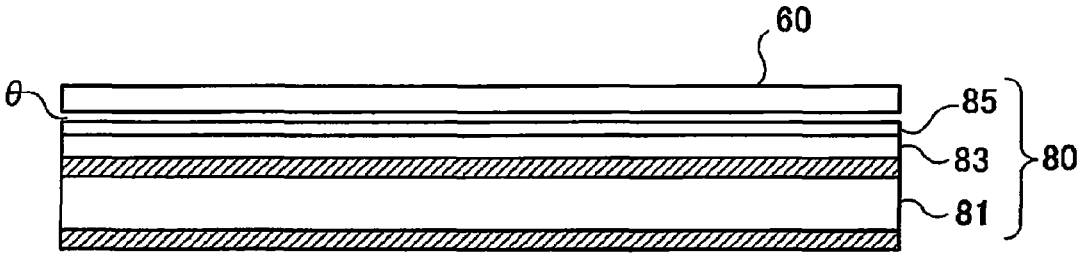
FIG. 6 is a schematic explanatory diagram of the fixing belt and an auxiliary heat generating section in the embodiment.

The auxiliary heat generating section 80 includes a thin metal plate 83 and a heat pipe 81 on the inner side of the fixing belt 60. The metal plate 83 has an arcuate shape extending along the shape of the fixing belt 60. As shown in FIG. 6, the metal plate 83 is set a very small space θ apart from the fixing belt 60 or in contact with the fixing belt 60. The metal plate 83 includes a fluorine-coated release layer 85 on a surface that slides against the fixing belt 60. As the metal plate 83, a magnetic member such as iron is used. The metal plate 83 generates an eddy-current using an induction current of the IH coil 70 and inductively heats, and supports the heat generation of the fixing belt 60. A temperature-sensitive magnetic member may be used instead of the metal plate 83.

Figure 7:
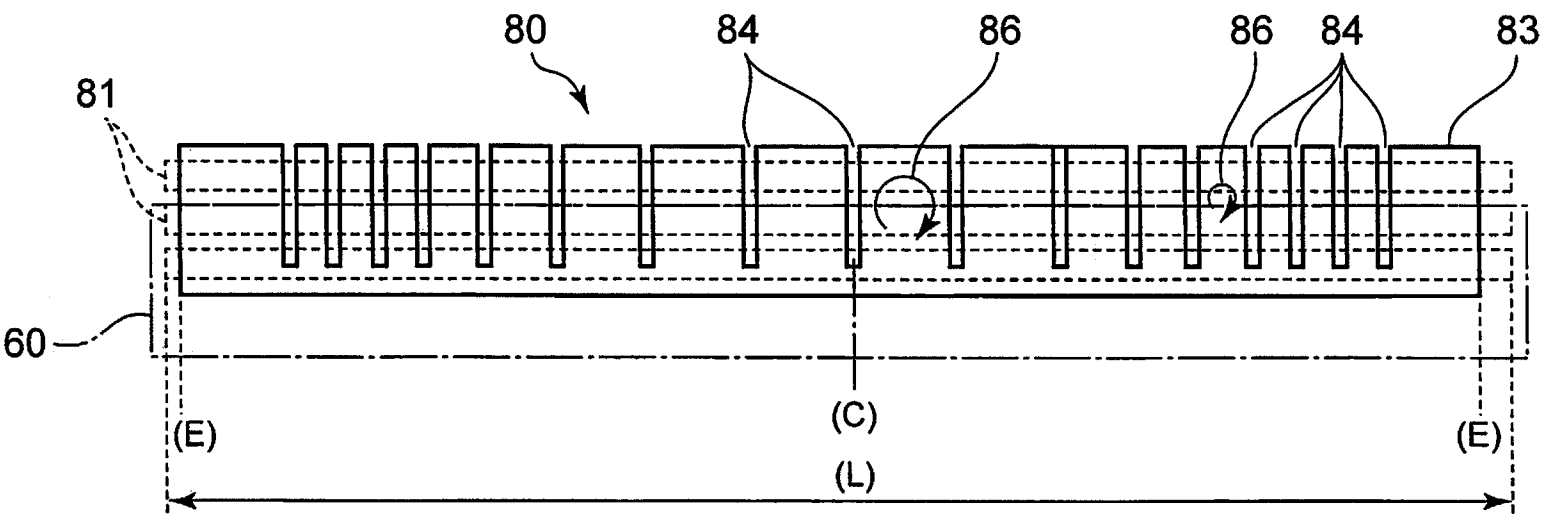
FIG. 7 is a schematic explanatory diagram of slits of a metal plate in the embodiment.

As shown in FIG. 7, the metal plate 83 includes slits 84 over the entire region of the metal plate 83. The slits 84 divide an eddy-current 86 generated in the metal plate 83. The slits 84 change the eddy-current 86 flowing in the metal plate 83 to small swirls generated among the slits 84. The induction heat generation of the metal plate 83 including the slits 84 is reduced compared with induction heat generation of a metal plate without slits.

It is possible to change induction heat generation conditions for the metal plate 83 by changing the interval of the slits 84 of the metal plate 83. For example, the interval of the slits 84 is set wide in the center (C) of the metal plate 83 and set narrow at the ends (E) of the metal plate 83. Induction heat generation caused by the IH coil 70 is high and heat supply to the fixing belt 60 is large in the peripheral region of the center (C) of the metal plate 83 compared with induction heat generation and heat supply in the peripheral regions of the ends (E) of the metal plate 83. In the peripheral regions of the ends (E) of the metal plate 83, the induction heat generation caused by the IH coil 70 is low and the heat supply to the fixing belt 60 is small.

For example, in the case of continuous paper feeding, a heat supply amount from the metal plate 83 to the fixing belt 60 is increased to maintain fixing temperature in a paper passing region in the peripheral region of the center (C) by adjusting the interval of the slits 84. In non-paper passing regions in the peripheral regions of the ends (E), the heat supply to the fixing belt 60 is suppressed to prevent the temperature of the fixing belt in the non-paper passing regions from excessively rising to overheat.

The heat pipe 81 is in contact with the inner side of the metal plate 83. The heat pipe 81 is formed by injecting a solvent such as water into plural hollow sections, for example formed by pultrusion molding an aluminum material. The length (L) of the heat pipe 81 is set to arrange the heat pipe 81 over the entire heating region of the metal plate 83. The heat pipe 81 realizes equalization of the temperature of the entire region in a longitudinal direction (a direction orthogonal to the arrow "f" direction, which is the rotating direction of the fixing belt 60) of the fixing belt 60 and the metal plate 83. The heat pipe 81 is formed of a nonmagnetic material such as aluminum to block a magnetic field from the IH coil 70 from transmitting through the metal plate 83 and reaching the inside of the fixing belt 60.

The auxiliary heat generating section 80 including the metal plate 83 and the heat pipe 81 is elastically supported by the stay 90 via springs 87. The springs 87 adjust an arrangement position of the auxiliary heat generating section 80 in the direction of the fixing belt 60 to set the auxiliary heat generating section 80 close to and the very small space θ apart from the fixing belt 60 or set the auxiliary heat generating section 80 in contact with the fixing belt 60. The auxiliary heat generating section 80 having the heat capacity is set close to or in contact with the fixing belt 60 to increase the heat capacity of a fixing region. If continuous printing at high speed is performed, a temperature fall in the fixing region due to a delay in heat supply by the fixing belt 60 is prevented using the fixing belt 60 having the extremely small heat capacity.

The auxiliary heat generating section 80 may be separated from the inner circumference of the fixing belt 60 at the beginning of the start of a warm-up of the fuser 32 and brought close to or into contact with the fixing belt 60 after the auxiliary heat generating section 80 is heated. Since the auxiliary heat generating section 80 having the heat capacity is separated from the fixing belt 60 at the beginning of the start of the warm-up, it is possible to prevent the auxiliary heat generating section 80 from depriving the heat of the fixing belt 60 and reduce the warm-up time.

The operation of the fuser 32 is explained.

If start a warm-up by turning on a power supply of the MFP 1 or restart from sleep mode of the MFP 1, the fuser 32 pressurizes the press roller 61 in the direction of the fixing belt 60 with the pressurizing mechanism 68. The fuser 32 forms, with the pressurizing force of the pressurizing mechanism 68, the nip 78 between the fixing belt 60 and the press roller 61 while the fixing belt 60 reaches from the inlet roller 72 to the outlet roller 73. The fuser 32 drives the motor 63 to rotate the press roller 61 in an arrow "g" direction via the gear group 63*a* and rotate the fixing belt 60 in the arrow "f" direction following the press roller 61. The fuser 32 excites the IH coil 70 and starts the heat generation of the fixing belt 60 and the metal plate 83. The auxiliary heat generating section 80 conducts the heat of the metal plate 83 to the fixing belt 60 via the very small space θ.

If the nip 78 is formed between the fixing belt 60 and the press roller 61, the relation among the lengths of the press roller 61, the inlet roller 72 and the outlet roller 73, and the guide 77 is the guide 77<the inlet roller 72 and the outlet roller 73<the press roller 61.

Figure 8:
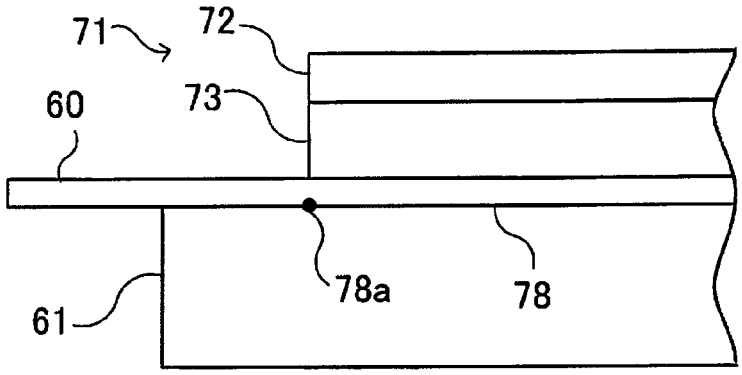
FIG. 8 is a schematic explanatory diagram of a nip end of the fixing belt and the press roller in the embodiment.

Since the length of the inlet roller 72 and the outlet roller 73 is smaller than the length of the press roller 61, deterioration of the fixing belt 60 is prevented. As shown in FIG. 8, if the inlet roller 72 and the outlet roller 73 are formed shorter than the press roller 61, at a nip end 78*a*, the fixing belt 60 is supported by the press roller 61. At the nip end 78*a*, a load by the inlet roller 72 or the outlet roller 73 is not applied to the fixing belt 60. Therefore, deterioration of the fixing belt 60 at the nip end 78*a* is prevented.

Figure 9:
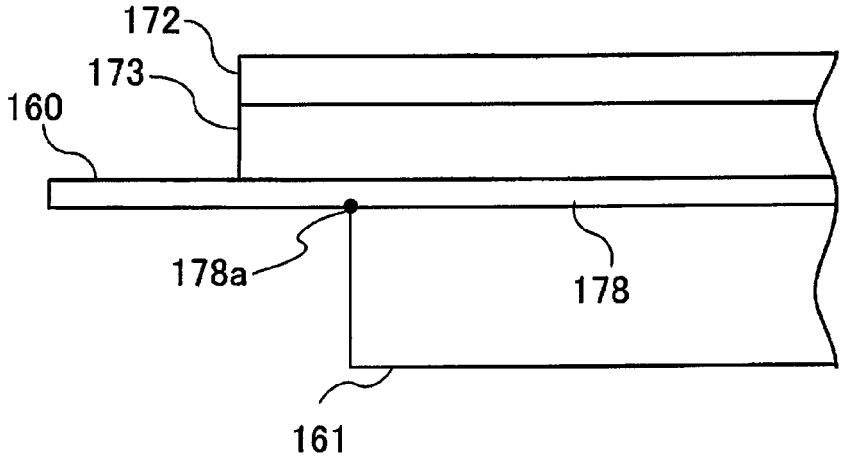
FIG. 9 is a schematic explanatory diagram of a nip end of a fixing belt and a press roller in a comparative example.

On the other hand, for example, as a comparative example, as shown in FIG. 9, an inlet roller 172 and an outlet roller 173 are formed longer than a press roller 161. At a nip end 178*a*, a fixing belt 160 receives a load of the end of the press roller 161. It is likely that deterioration occurs in a portion of the fixing belt 160 set in contact with the end of the press roller 161.

In the embodiment, since the length of the guide 77 is smaller than the length of the inlet roller 72 and the outlet roller 73, the deterioration of the fixing belt 60 is prevented. If the guide 77 is formed shorter than the inlet roller 72 and the outlet roller 73, as indicated by a solid line in FIG. 10, a guide end 77*a* is present in the region of the nip 78. If the guide end 77*a* is present in the region of the nip 78, even if the fixing belt 60 lifts and comes into contact with the guide 77, a load applied to the fixing belt 60 is small.

Figure 10:
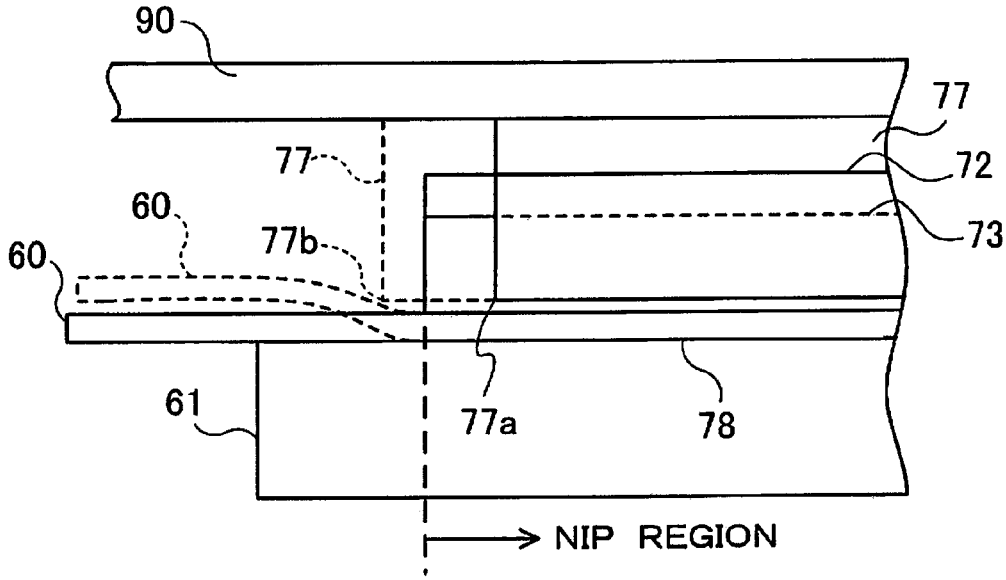
FIG. 10 is a schematic explanatory diagram of ends of the guide and the press roller in the embodiment.

On the other hand, if the guide 77 is formed longer than the inlet roller 72 and the outlet roller 73, as indicated by a dotted line in FIG. 10, a guide end 77*b* is present outside the region of the nip 78. It is likely that, outside the region of the nip 78, the lift of the fixing belt 60 is larger. If the guide end 77*b* is present outside the region of the nip 78, it is likely that the fixing belt 60 lifting as indicated by a dotted line comes into contact with the guide end 77*b* and receives a load to be deteriorated.

If the temperature of the fixing belt 60 reaches a ready temperature, the fuser 32 completes the warm-up. After the completion of the warm-up, the fuser 32 controls the IH coil 70 to be turned on and off according to a detection result of the thermistor 66 and keeps the fixing belt 60 at the ready temperature. The pressurizing mechanism 68 reduces the pressurizing force of the press roller 61 set in contact with the fixing belt 60 from a pressurizing force for the warm-up to a pressurizing force for a ready mode.

In the ready mode, while the fixing belt 60 rotates in the arrow "f" direction, the movement of the fixing belt 60 in the direction perpendicular to the traveling direction is suppressed by, the guide 77. The fixing belt 60 keeps the stable shape extending along the outer circumference of the press roller 61 from the inlet roller 72 to the outlet roller 73.

If the MFP 1 starts printing, the fuser 32 holds the sheet P, which has a toner image formed by the printer section 10, in the nip 78 and conveys the sheet P in an arrow "h" direction. The pressurizing mechanism 68 increases the pressurizing force of the press roller 61 set in contact with the fixing belt 60 from the pressurizing force for the ready mode to a pressurizing force for a print mode.

The fuser 32 leads the sheet P into the nip 78 from the inlet roller 72 side. The fuser 32 heats and pressurizes the toner image and fixes the toner image on the sheet P while the led-in sheet P passes through the nip 78. The movement of the fixing belt 60 between the inlet roller 72 and the outlet roller 73 is suppressed by the guide 77. The fixing belt 60 keeps the shape extending along the outer circumference of the press roller 61. While the fixing belt 60 reaches from the inlet roller 72 to the outlet roller 73, the fuser 32 stably supplies heat and pressure to the toner image via the nip 78 having the shape extending along the press roller 61.

The inlet pressing roller 74 and the outlet pressing roller 76 respectively rotate in contact with the center regions of the inlet roller 72 and the outlet roller 73 while conveying the sheet P and prevent the inlet roller 72 and the outlet roller 73 from bending. The inlet pressing roller 74 and the outlet pressing roller 76 stably form the width of the nip 78 from the inlet roller 72 to the outlet roller 73.

If the toner image is heated, pressurized, and fixed on the sheet P, although the heat capacity of the fixing belt 60 is small, the fixing belt 60 obtains a sufficient heat quantity from heat directly generated by a magnetic flux of the IH coil 70 and heat conducted from the auxiliary heat generating section 80.

During the fixing, the auxiliary heat generating section 80 supplies the heat quantity to the paper passing region of the fixing belt 60. In the auxiliary heat generating section 80, if the temperature in a region opposed to the paper passing region of the metal plate 83 falls, the heat pipe 81 transports the heat of the non-paper passing regions of the metal plate 83 to the paper passing region. The temperature of the paper passing region of the metal plate 83 is prevented from falling by the heat transportation by the heat pipe 81. Equalization of the heat of the metal plate 83 and equalization of the heat of the fixing belt 60 are realized by the heat pipe 81.

Even in continuous printing in the high-speed MFP 1, the heat capacity of the fixing belt 60 is substantially increased by the auxiliary heat generating section 80 to prevent a temperature fall of the fixing belt 60.

If the sheet P is a small size sheet, if fixing is continued, temperature falls in the paper passing region of the fixing belt 60 and temperature gradually rises in the non-paper passing regions of the fixing belt 60. In the region opposed to the paper passing region, the metal plate 83 conducts the heat of the metal plate 83 in a direction in which the heat is given to the fixing belt 60. In the regions opposed to the non-paper passing regions, the heat of the fixing belt 60 is conducted in a direction in which the heat is given to the metal plate 83.

The peripheral regions of the ends (E) of the metal plate 83 opposed to the non-paper passing regions of the fixing belt 60 have a small generated heat quantity. Therefore, the heat of the non-paper passing regions of the fixing belt 60 is smoothly conducted to the metal plate 83. The heat pipe 81 transports the heat of the regions of the ends (E) where the temperature rises in the metal plate 83 to the region of the center (C) where the temperature falls. The heat of the metal plate 83 is equalized. A temperature fall in the paper passing region of the fixing belt 60 is prevented and overheat of the non-paper passing region is prevented.

During the driving of the fuser 32, for example, if the fixing belt 60 or the metal plate 83 abnormally generates heat, the thermostat 67 functions to cut off the power supply to the IH coil 70.

The fuser 32 discharges the sheet P, which undergoes the heating, pressurizing, and fixing in the nip 78, from the outlet roller 73. Since the outlet roller 73 has the small outer diameter and the high rubber hardness, the outlet roller 73 easily peels the leading end of the sheet P off from the fixing belt 60.

According to the embodiment, the nip 78 is formed between the fixing belt 60 and the press roller 61 using the nip forming section 71 including the inlet roller 72 and the outlet roller 73. A friction force by the nip forming section 71 against the fixing belt 60 is small and a load applied to the fixing belt 60 by the nip forming section 71 is small. Rotation torque necessary for the driving of the fixing belt 60 is reduced to obtain stable driving of the fixing belt 60. The wear of the fixing belt 60 due to friction with the nip forming section 71 is reduced to extend the life of the fixing belt 60.

According to the embodiment, the guide 77 is arranged between the inlet roller 72 and the outlet roller 73 to suppress the movement of the fixing belt 60. The nip 78 reaching from the inlet roller 72 to the outlet, roller 73 stably supplies heat and pressure to the toner image formed on the sheet P.

According to the embodiment, the lengths of the press roller 61, the inlet roller 72 and the outlet roller 73, and the guide 77 is set as the guide 77<the inlet roller 72 and the outlet roller 73<the press roller 61. Since a load by the end of the nip forming section 71 is not applied to the fixing belt 60, the deterioration of the fixing belt 60 in the nip end 78*a* is prevented.

According to the embodiment, the outer diameter of the outlet roller 73 is set small or the hardness of the outlet roller 73 is set high. Peelability from the fixing belt 60 of the leading end of the sheet P passed through the nip 78 is improved.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A fuser comprising:

a fixing belt including a conductive layer;

an induction-current generating section configured to electromagnetically induction-heat the conductive layer;

a pressurizing section opposed to an outer circumference of the fixing belt; and a nip forming section configured to form a nip between the fixing belt and the pressurizing section and including: a first supporting roller present in an inner circumference of the fixing belt and having a width narrower than a width of the pressurizing section, a second supporting roller present downstream of the first supporting roller in a rotating direction of the fixing belt and having a width narrower than the width of the pressurizing section, and a guide present between the first supporting roller and the second supporting roller, the guide having a width narrower than the width of the first supporting roller and the width of the second supporting roller, and the guide extending in the width direction of, and opposed to an outer circumference of, the pressurizing section.

2. The fuser according to claim 1, wherein an outer diameter of the second supporting roller is smaller than an outer diameter of the first supporting roller.

3. The fuser according to claim 1, wherein a hardness of the second supporting roller is higher than a hardness of the first supporting roller.

4. The fuser according to claim 1, further comprising:

a first pressing roller set in contact with the first supporting roller; and a second pressing roller set in contact with the second supporting roller, the first pressing roller and the second pressing roller being provided on a side opposite to the fixing belt.

5. An image forming apparatus comprising:

an image forming section configured to form an image on a recording medium;

a fixing belt including a conductive layer and configured to come into contact with the recording medium having the image;

an induction-current generating section configured to electromagnetically induction-heat the conductive layer;

a pressurizing section opposed to an outer circumference of the fixing belt; and a nip forming section configured to form a nip between the fixing belt and the pressurizing section and including: a first supporting roller present in an inner circumference of the fixing belt and having a width narrower than a width of the pressurizing section, a second supporting roller present downstream of the first supporting roller in a rotating direction of the fixing belt and having a width narrower than the width of the pressurizing section, and a guide present between the first supporting roller and the second supporting roller, the guide having a width narrower than the width of the first supporting roller and the width of the second supporting roller, and the guide extending in the width direction of, and opposed to an outer circumference of, the pressurizing section.

6. The apparatus according to claim 5, wherein an outer diameter of the second supporting roller is smaller than an outer diameter of the first supporting roller.

7. The apparatus according to claim 5, wherein a hardness of the second supporting roller is higher than a hardness of the first supporting roller.

8. The apparatus according to claim 5, further comprising:

a first pressing roller set in contact with the first supporting roller; and a second pressing roller set in contact with the second supporting roller, the first pressing roller and the second pressing roller being provided on a side opposite to the fixing belt.

* * * * *